US008491327B2

(12) United States Patent
Hartmann

(10) Patent No.: US 8,491,327 B2
(45) Date of Patent: Jul. 23, 2013

(54) ELECTRICAL TERMINAL COMPONENT THAT FORMS CLAMPING POINTS FOR ELECTRICAL CONDUCTORS

(75) Inventor: Frank Hartmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 13/301,919

(22) Filed: Nov. 22, 2011

(65) Prior Publication Data

US 2012/0196459 A1 Aug. 2, 2012

(30) Foreign Application Priority Data

Nov. 22, 2010 (DE) ..... 10 2010 051 899

(51) Int. Cl.
*H01R 4/24* (2006.01)

(52) U.S. Cl.
USPC ..... 439/441

(58) Field of Classification Search
USPC ..... 439/439, 441, 839
See application file for complete search history.

(56) References Cited

U.S. PATENT DOCUMENTS

| | | | | |
|---|---|---|---|---|
| 5,975,940 | A * | 11/1999 | Hartmann et al. | 439/441 |
| 6,132,238 | A * | 10/2000 | Hartmann et al. | 439/439 |
| 6,261,120 | B1 * | 7/2001 | Beege et al. | 439/441 |
| 6,814,608 | B2 * | 11/2004 | Kollmann | 439/441 |
| 6,893,286 | B2 * | 5/2005 | Drewes et al. | 439/441 |
| 7,101,231 | B2 * | 9/2006 | Prokup et al. | 439/709 |
| 7,384,319 | B2 * | 6/2008 | Kirstein et al. | 439/839 |
| 7,507,106 | B2 * | 3/2009 | Keswani et al. | 439/439 |

FOREIGN PATENT DOCUMENTS

| | | | |
|---|---|---|---|
| DE | 2825291 | C2 | 9/1987 |
| DE | 4132407 | A1 | 4/1993 |
| DE | 29921249 | U1 | 4/2000 |
| DE | 19934555 | C1 | 4/2001 |
| DE | 19945817 | C2 | 9/2001 |
| DE | 10103145 | C1 | 6/2002 |
| DE | 20105501 | U1 | 9/2002 |
| DE | 19918842 | B4 | 8/2006 |
| DE | 19940971 | B4 | 6/2009 |
| EP | 1391965 | B1 | 1/2009 |
| EP | 1587166 | B1 | 5/2010 |

* cited by examiner

*Primary Examiner* — Chandrika Prasad
(74) *Attorney, Agent, or Firm* — Renner, Otto, Boisselle & Sklar, LLP

(57) ABSTRACT

An electrical terminal component having an insulating material housing, a busbar installed in the insulating material housing and at least one clamping spring, which springs are arranged on the busbar so as to form clamping points for electrical conductors, is described. The busbar has a flat busbar region in which at least four conductor leadthrough openings, which are each surrounded by side walls projecting from the flat busbar region and a contact wall projecting from the flat busbar region and having a clamping contact point for making contact with an electrical conductor are made, two conductor leadthrough openings being arranged behind one another in the direction of longitudinal extent (T) of the conductor leadthrough openings, and at least two such pairs of conductor leadthrough openings arranged behind one another being arranged beside one another in a width direction (B) which extends over the narrow side of the conductor leadthrough openings.

11 Claims, 8 Drawing Sheets

ELECTRICAL TERMINAL COMPONENT THAT FORMS CLAMPING POINTS FOR ELECTRICAL CONDUCTORS

FIELD OF INVENTION

The invention relates to an electrical terminal component having an insulating material housing, a busbar installed in the insulating material housing and at least one clamping spring, which springs are arranged on the busbar so as to form clamping points for electrical conductors.

The invention also relates to a transverse link for such an electrical terminal component and to a contact spring semi-finished product in the form of a spring plate which extends in a longitudinal direction.

BACKGROUND

Various terminal components with clamping springs for connecting electrical conductors are known. In conjunction with a busbar which bears a plurality of clamping springs for forming clamping points, the terminal components may be used as collective connections for potential distribution.

DE 101 03 145 C1 discloses a terminal block for electrical distribution boards having a conductor rail and a multiplicity of connection elements for connecting conductors, which are to be connected, to the conductor rail. The conductor rail may be in the form of an angled busbar with openings for inserting conductors to be connected. Clamping springs are respectively hooked into the openings, a plurality of openings being arranged along the length of the conductor rail section in order to form a single-row terminal component.

DE 199 18 842 B4 discloses a multi-row collective connection for electrical distribution installations, in which two L-shaped insulating material housings are interleaved in one another in an offset manner. The busbars of the two rows are not connected to one another in an electrically conductive manner. The busbars have a cage tension spring for receiving an electrical conductor with a large cross section and adjoining leaf spring tongues for connecting conductors with a smaller cross section.

DE 199 34 555 C1 shows a terminal block for electrical distribution boards having spring terminal connections which are arranged along a row and are intended to receive conductors with a small cross section and having a screw terminal connection for connecting a conductor with a large cross section.

Comparable collective terminal blocks are also known from DE 199 40 971 B4, DE 199 45 817 C2, DE 201 05 501 U1, DE 299 21 249 U1 and EP 1 587 166 B1.

DE 41 32 407 A1 discloses a collective connection for electrical distribution installations, in which a busbar is divided into an upper deck and a lower deck which run substantially parallel to one another. Cage tension springs are suspended in two rows above one another on the busbar of the upper and lower decks. In addition, cage tension springs of a larger dimension are suspended only from the lower deck, these cage tension springs occupying the space actually intended for the upper deck.

DE 28 25 291 C1 and EP 1 391 965 B1 also disclose electrical spring force terminal connections with a hole collar which extends in the conductor push-through direction. A clamping point for an electrical conductor is formed between the hole collar inner wall surface and an end of a leaf spring that extends into a material passage.

SUMMARY

On the basis of this, the object of the present invention is to provide an improved electrical terminal component.

The object is achieved with the electrical terminal component of the type mentioned at the outset by virtue of the fact that the busbar has a flat busbar region in which at least four conductor leadthrough openings, which are each surrounded by side walls projecting from the flat busbar region and a contact wall projecting from the flat busbar region and having a clamping contact point for making contact with an electrical conductor, are made, two conductor leadthrough openings being arranged behind one another in the direction of longitudinal extent of the conductor leadthrough openings, and at least two such pairs of conductor leadthrough openings arranged behind one another being arranged beside one another in a width direction which extends over the narrow side of the conductor leadthrough openings.

It is thus proposed to produce a plurality of clamping contact points on a flat busbar region of a busbar with the aid of material passages through the flat busbar region which are arranged beside one another and behind one another. In this case, conductor leadthrough openings which are bounded by side walls and at least one end wall are made in the flat busbar region. An end wall then forms a contact wall for making contact with an electrical conductor.

The electrical terminal component therefore makes use of the passage technology for spring force terminal connections which is known per se and allows electrical conductors to be directly plugged without previously actuating the clamping springs. In this case, it was recognized that material passages can also be implemented relatively closely adjacent to one another with side walls which are beside one another. Such material passages are produced in the deep-drawing method, the flat busbar region adjoining the material passage having to fixedly rest on a mating bearing of a deep-drawing die. Despite these requirements, it has been shown that such conductor leadthrough openings can be implemented close to one another in the form of a material passage.

In addition, clamping contact points need to be formed on the contact walls. It has been shown that such clamping contact points can also be introduced in the case of conductor leadthrough openings which are arranged behind one another. This is possible, in particular, when a common clamping spring with mutually opposite clamping limbs interacts with the mutually opposite contact walls of a pair of conductor leadthrough openings arranged behind one another. The contact walls of the pair of conductor leadthrough openings arranged behind one another are then accessible for a tool in order to form, for example, a clamping contact point by making a transverse edge. Such a transverse edge then projects from a perpendicular to the flat busbar region, which rests against the inside of the contact wall above the clamping contact point, in the direction of the conductor leadthrough opening.

At least one pair of conductor leadthrough openings arranged behind one another may each be separated from one another by a web in the plane of the busbar. Two completely independent conductor leadthrough openings are then arranged behind one another and are separated from one another by the web and possibly by end walls adjoining the web at the ends of the conductor leadthrough openings. In such an embodiment, the stability of the busbar and the current-carrying cross section are increased.

However, it is also conceivable for at least one pair of conductor leadthrough openings arranged behind one another to each merge into one another and to form a common opening closed on all sides in the plane of the busbar. The mutually opposite contact walls are used to form two clamping points for a respective associated electrical conductor. Such an embodiment facilitates production. A sufficient cross section for transmitting current between the clamping points is ensured by means of common side walls.

It is particularly advantageous if link contact openings for receiving and making contact with transverse link elements are provided on that plane of the busbar which has the conductor leadthrough openings. As a result of the fact that the link contact openings are made on the same busbar plane together with the conductor leadthrough openings, electrical conductors and links can be plugged into the electrical terminal component from the same side. This facilitates handling, in particular if the electrical terminal component is installed in a switchgear cabinet.

In this case, the link contact openings may be arranged on a plane which is angled from that plane of the busbar which has the conductor leadthrough openings by a maximum of 20°. As a result of the busbar being angled, it is possible to reduce the overall height since the contact point for the transverse link is at a lower point.

In one preferred embodiment, material flaps project downward from the plane of the busbar in the insertion direction of a link at the lateral edges of the link contact openings. This has the advantage that the material flaps arranged on the inner edges of the link contact openings increase the size of the contact area for a link contact and the contact point of the link is moved downward from the busbar plane. The material flap advantageously forms an insertion funnel for inserting the transverse link. In addition, busbar material which is available anyway is used to form the material flaps without additional material having to be provided. This advantageously reduces the necessary overall height of the electrical terminal component. The clamping contacts of the links are preferably in the form of spring contacts with two spring arms which are spaced apart from one another by a slot.

In order to reduce the overall height for the electrical terminal component, it is particularly advantageous to use a transverse link for such an electrical terminal component, which transverse link has an electrically conductive transverse web and at least two contact arms which leave from the transverse web and are spaced apart from one another. In this case, the transverse web is bent away from the axis of extent of the contact arms and is at an acute angle to the contact arms. Therefore, the cross section is not above the contact arms on the same plane as usual but rather is bent back, with the result that the plane of the transverse web extends parallel to the plane of the contact arms. The installation space beside the contact arms is used to receive the transverse web.

It is also advantageous if the clamping springs each have a spring bow and at least two pairs of mutually opposite clamping sections which adjoin the common spring bow and each interact with one of the two opposite contact walls of a pair of conductor leadthrough openings arranged behind one another. In this way, electrical conductors which each adjoin the two opposite contact walls of a pair of conductor leadthrough openings arranged behind one another can be clamped to the clamping limbs to the two clamping limbs. Clamping limbs, which are arranged beside one another, of two adjacent pairs of clamping limbs of the common clamping spring are separated from one another by a clearance.

Such a clamping spring having at least four clamping limbs can be produced in an inexpensive manner and, in particular, can be handled well. Above all, with the conductor leadthrough openings arranged close to one another, such a clamping spring can be easily inserted into the conductor leadthrough openings by machine.

A particular advantage of this type of clamping spring is also that the available clamping force is distributed to the electrical conductors in the best possible manner. If only one electrical conductor is connected, not only the clamping section opposite the electrical conductor ensures that the clamping force is increased. Rather, the diagonally opposite clamping section also contributes to applying a clamping force to the electrical conductor. Even in the case of two or three inserted electrical conductors in a clamping spring consisting of two pairs of clamping limbs, the remaining clamping limb contributes to applying a clamping force to the electrical conductors with the aid of the common spring bow.

In particular, in order to use the electrical terminal component as a potential distributor, it is advantageous to provide at least one clamping point having a larger cross section. For this purpose, it is proposed to provide, adjoining the adjacently arranged pairs of conductor leadthrough openings, a further individual conductor leadthrough opening having side walls, which extend away from the plane of the busbar and bound the conductor leadthrough opening, and having a contact wall. A clamping spring is then inserted into this individual conductor leadthrough opening.

In order to increase the modularity, it is particularly advantageous in this case if the width of the individual conductor leadthrough opening together with the lateral webs which bound the conductor leadthrough opening corresponds to the width of two adjacently arranged pairs of conductor leadthrough openings together with the lateral webs which bound said openings. This retains the division ratio, which allows a flexible modular design and free configuration by the user and allows an electrical conductor with a larger cross section to be connected with the aid of the individual conductor leadthrough opening.

The insulating material housing of the electrical terminal component preferably has two mutually opposite recessed grips on the outside. The terminal component can thus be gripped well and can be placed and/or latched, for example, on a supporting rail or a support in a switchgear cabinet.

A supporting rail holder can be integrated in the insulating material housing on the underside or it is also conceivable to provide an intermediate element as a supporting rail holder and to connect the insulating material housing to said intermediate element.

A particularly inexpensive, easy-to-handle implementation of the clamping spring can be achieved with a contact spring semi-finished product in the form of a spring plate extending in a longitudinal direction. The contact spring semi-finished product has, in the longitudinal direction, a material region which forms a continuous spring bow. Transversely to the longitudinal direction, material tongues which extend from the continuous material region to the lateral edges and form a multiplicity of contact sections which are spaced apart from one another by a clearance are provided. Contact springs with any desired number of pairs of contact sections which face away from one another, preferably two or more pairs, can then be cut to length from such a contact spring semi-finished product.

With the aid of the transverse link, adjacent terminal components can be combined to form a modular busbar, in particular also by interconnecting a plurality of different terminal components. Flexible, economic automatic production of different modules is possible on account of the division-related modularity.

DESCRIPTION OF THE DRAWINGS

The invention is explained in more detail below using exemplary embodiments with the accompanying drawings, in which.

DETAILED DESCRIPTION

Figure 1:
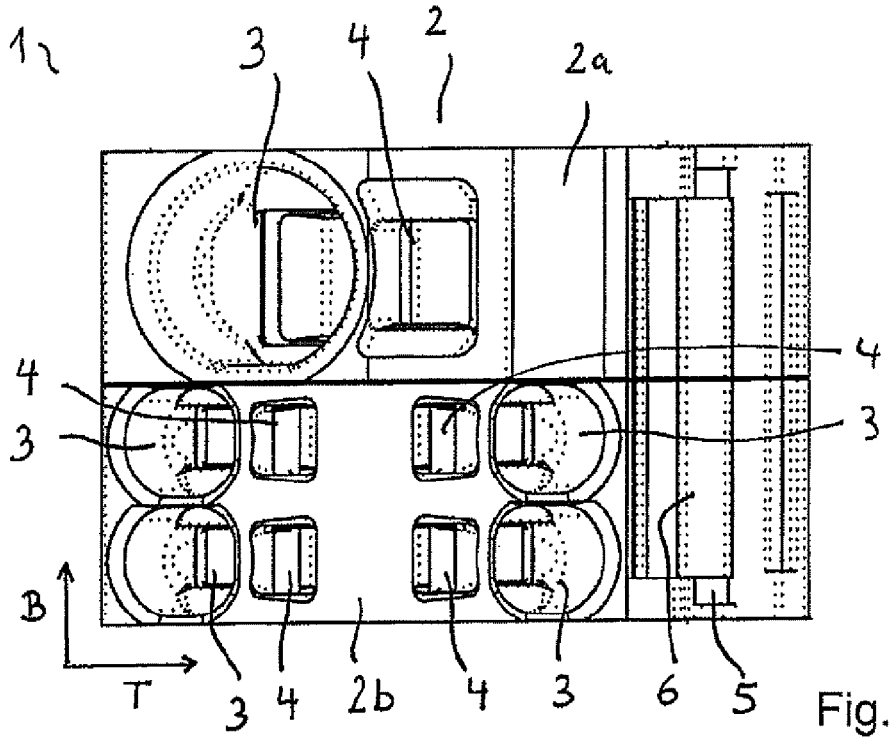
FIG. 1*a*) shows a plan view of the insulating material housing in a first embodiment of an electrical terminal component.
FIG. 1*b*) shows a side view of a first housing half of the insulating material housing from FIG. 1*a;*
FIG. 1*c*) shows a side view of the second housing half of the insulating material housing from FIG. 1*a;*
Figure 1:
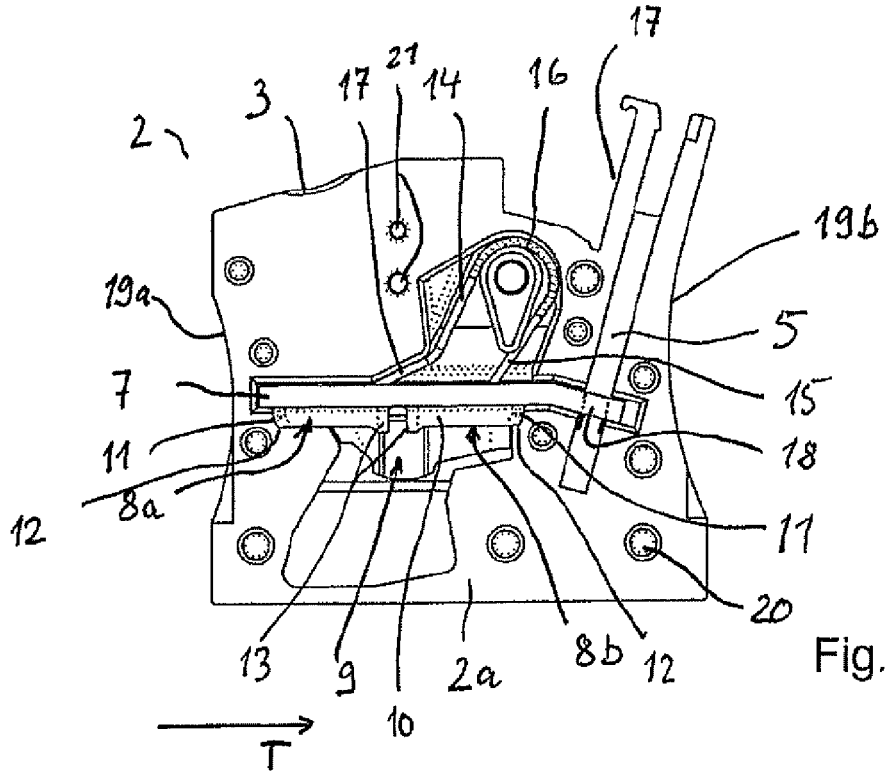
Figure 1:
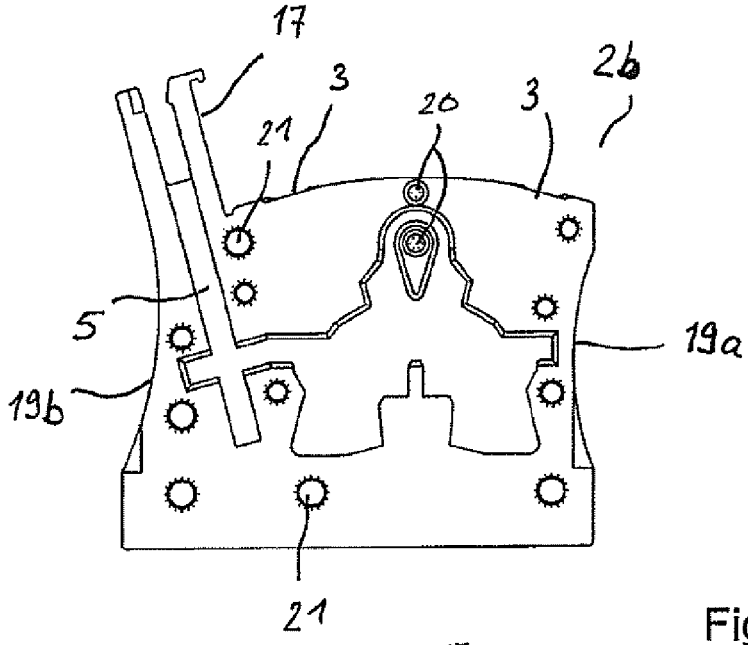

FIG. 1*a* indicates a plan view of a first embodiment of an electrical terminal component 1. The terminal component 1 has an insulating material housing 2 formed from two housing parts 2*a* and 2*b*.

A single conductor insertion opening 3 and, adjacent to the latter, an actuating opening 4 which result in a spring clamping point are made in the first housing part 2*a*.

Two conductor insertion openings 3 which are close behind one another in the direction of the depth T and each have adjoining actuating openings 4 are provided in the second housing half 2*b*. Directly beside such a pair of conductor insertion openings 3 which are arranged behind one another and have associated actuating openings 4, a further pair of such conductor insertion openings 3 with associated actuating openings 4 is provided in the direction of the width B. A link insertion opening 5 for inserting a transverse link 6 into the insulating material housing 2 is respectively located in each housing half in the direction of the depth T behind the pairs of conductor insertion openings 3 arranged behind one another.

It can be seen that the pairs of conductor insertion openings 3 arranged behind one another extend from one another in opposite directions at the conventional insertion angle of a maximum of 45° to the perpendicular to a busbar. The electrical conductors are inserted obliquely from the front for the front conductor insertion openings 3 and are inserted obliquely from the rear for the rear conductor insertion openings, with the result that the actuating openings 4 in between remain accessible.

FIG. 1*b*) indicates a side view of the first housing half 2*a*. It becomes clear that a busbar 7 having a flat busbar region has been introduced into the second housing half 2*a* of the insulating material housing 2. This busbar 7 has conductor leadthrough openings 8*a*, 8*b* which are arranged behind one another in the direction of the depth T, are surrounded by the second housing half 2*b* and are oriented to the conductor insertion openings 3 arranged behind one another.

A single central conductor leadthrough opening 9 for the single conductor insertion opening 3 is also provided in the first housing half 2*a*.

The conductor leadthrough openings 8*a*, 8*b* and 9 are in the form of a material passage in the flat busbar region of the busbar 7 and have side walls 10, which preferably each project vertically downward from the flat busbar region in a manner spaced apart from one another, and, at an end of the conductor leadthrough openings 8*a*, 8*b*, 9, a contact wall 11 having a clamping contact point for making contact with an electrical conductor. In the exemplary embodiment illustrated, the clamping contact point 12 is formed by moving the lower edge region of the contact wall 11 forward in the direction of the opposite end wall 13. In the plan view of the busbar 7, the clamping contact point 12 thus projects into the conductor leadthrough opening, as seen through the conductor leadthrough opening 8*a*, 8*b*, 9, with the result that an electrical conductor comes into contact only with the clamping contact point 12 in an area which is as small as possible. The clamping force of the clamping spring 14 respectively inserted into the conductor leadthrough openings 8*a*, 8*b*, 9 is thus concentrated on the clamping contact point 12 and thus optimizes the contact force for the electrical conductor.

In the first housing half 2*a*, the clamping point is realized using a single clamping spring 14 which is hooked into the single conductor leadthrough opening 9. The clamping spring 14 has, in a manner known per se, a bearing limb 15, a spring bow 16 adjoining the latter and a clamping limb 17 which, in the quiescent state without an inserted electrical conductor, rests against the contact wall 11 above the clamping contact point 12.

Seen in the direction of the depth T, a link shaft 5 for a transverse link is provided in the rear region in order to transmit voltage potential from a terminal component 1 to an adjacent terminal component with the aid of a transverse link. For this purpose, a link contact opening 18 which is aligned with the link shaft 5 and is intended to make electrical contact between a transverse link and the busbar 7 is made in the flat busbar region of the busbar 7.

A label receptacle may be formed on the front side 17 of that insulating material of the insulating material housing 2 which forms the link shaft 5. The label receptacle may have, in a manner known per se, latching elements for latching separate labels.

It can also be seen that recessed grips 19*a*, 19*b* are formed in the insulating material housing on the front side and rear side of the insulating material housing 2, as seen in the direction of the depth. The terminal component 1 can thus be safely handled and can be placed on a supporting rail, for example.

FIG. 1*c*) indicates a side view of the second housing half 2*b* at the contact surface with the first housing half 2*a* according to FIG. 1*b*). The side visible in FIG. 1*c*) is plugged onto the side visible in FIG. 1*b*). For this purpose, adjusting pins 20 which enter associated adjusting holes 21 can project from the side wall of the first and/or second housing half 2*a*, 2*b*.

It can be seen that a link shaft 5 and, adjoining the latter, a clearance for receiving the busbar 7 and a clamping spring are also provided in the second housing half 2*b*.

Figure 2:
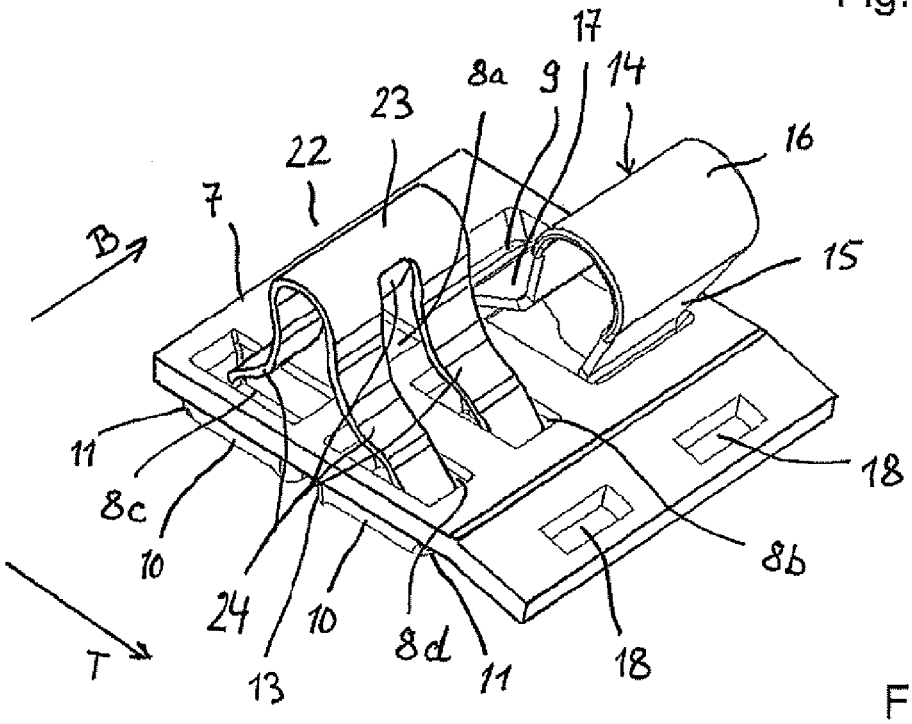
FIG. 2 shows a perspective plan view of a busbar with clamping springs, which have been inserted into conductor leadthrough openings, for the terminal component from FIGS. 1*a*) to *c*)

FIG. 2 indicates a perspective view of the busbar 7 with clamping springs 14, 22 which are used on the latter. It becomes clear that a single clamping spring 14 for forming a single clamping contact point for an electrical conductor is provided in the single conductor leadthrough opening 9 in the first housing half 2*a*. The width of this conductor connection is considerably wider than the width of the conductor leadthrough openings 8*a*, 8*b*, 8*c*, 8*d* which are arranged in two columns and two rows in the adjoining part of the busbar 7 and are accommodated in the second housing half 2*b*.

It can be seen that a clamping spring 22 which is bent in a U-shaped manner and has four clamping limbs 24 adjoining a common spring bow 23 has been inserted into the four conductor leadthrough openings 8*a* to 8*d*. These four conductor leadthrough openings 8*a*-8*d* thus use four clamping limbs 24 of the same clamping spring 22 to connect four electrical conductors independently of one another. The clamping limbs 24 of the four-limbed clamping spring 22 which are beside one another and extend in the same direction are each spaced apart from one another by a clearance and are integrally connected to the spring bow 23 on the same side of the latter. The clamping limbs 24 preferably conically converge from the spring bow 23 toward their free end and are bent several times along their length in order to optimize the clamping force and the conductor insertion force.

Seen in the direction of the depth T of the busbar 7, link contact openings 18 are provided on a flat busbar region of the busbar 7 behind a pair of conductor leadthrough openings 8*a*, 8*b* and 8*c*, 8*d* which are behind one another. The link contact openings 18 are arranged on a plane which is angled from that plane of the busbar 7 which has the conductor leadthrough openings 8*a*, 8*b*, 8*c*, 8*d* and 9 by a maximum of 20°. In the exemplary embodiment illustrated, the angle is approximately 15°.

Nevertheless, this is the same plane since the transverse links, like the electrical conductors, can be inserted into the electrical terminal component 1 in a slightly oblique manner, but from the top, like the electrical conductors.

Figure 3:
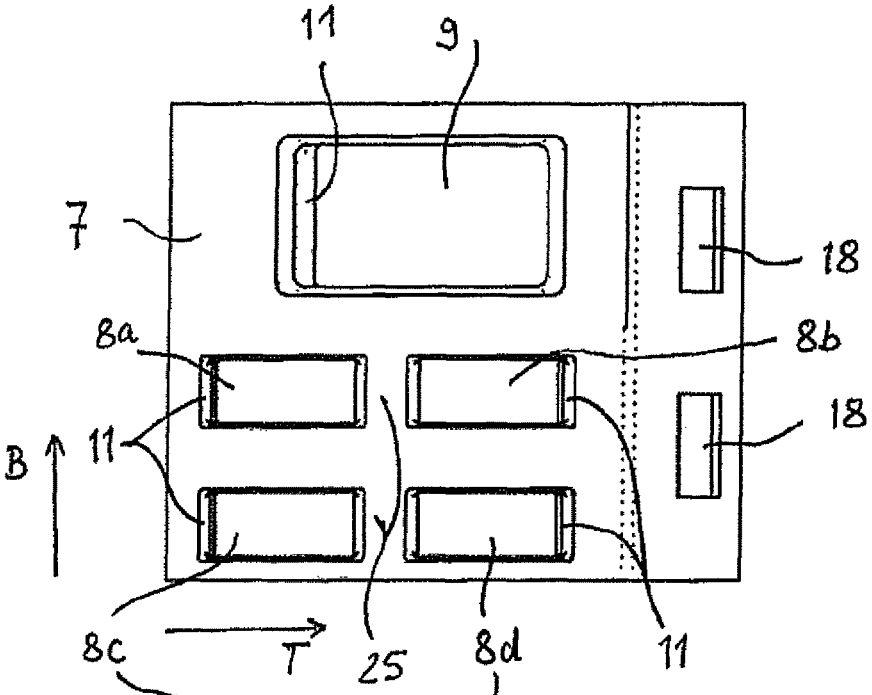
FIG. 3 shows a plan view of the busbar from FIG. 2.

FIG. 3 indicates a plan view of the busbar 7 for the electrical terminal component 1 from FIGS. 1 and 2. It becomes clear that two conductor leadthrough openings 8*a*, 8*b* and 8*c*, 8*d* are respectively arranged behind one another in two columns and, for example, two rows (as illustrated) in the form of a matrix in a section of the busbar and at least two such pairs 8*a*, 8*b* and 8*c*, 8*d* are arranged beside one another in a width direction B which extends over the narrow side of the conductor leadthrough openings 8*a*, 8*b*, 8*c*, 8*d*.

It becomes clear that all conductor leadthrough openings 8*a* to 8*d*, 9 and the link contact openings 18 are accessible from above to the same extent.

It can also be seen that the contact walls 11 of the conductor leadthrough openings 8*a*, 8*b*, 8*c*, 8*d* arranged in the form of a matrix are each arranged on the front side or rear side, as seen in the direction of the depth T.

A web 25 is provided between the conductor leadthrough openings 8*a*, 8*b* and 8*c*, 8*d* respectively arranged behind one another, with the result that the conductor leadthrough openings 8*a*, 8*b*, 8*c*, 8*d* are each completely surrounded by encircling walls which form the material passage, the walls projecting downward from the busbar 7.

In an embodiment which is not illustrated, it is possible to dispense with the web 25 with the adjoining end walls 13, if necessary, with the result that the side walls 10 of the conductor leadthrough openings 8*a*, 8*b* and 8*c*, 8*d* arranged behind one another merge into one another in order to form a single opening for two clamping points.

Figure 4:
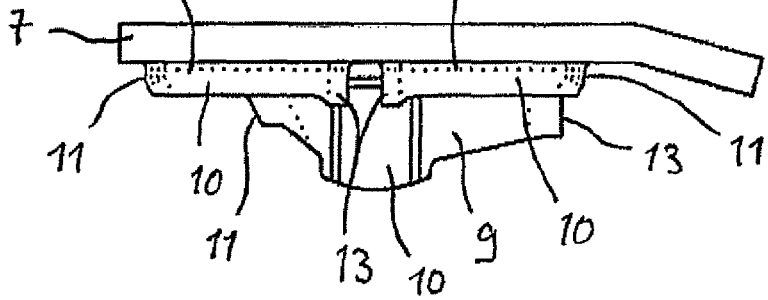
FIG. 4 shows a side view of the busbar from FIG. 2.

FIG. 4 indicates a side view of the busbar 7. It is clear that the single conductor leadthrough opening 9 has a greater depth than the smaller conductor leadthrough openings 8*a*, 8*b* and 8*c*, 8*d* arranged behind one another. The material passage of the conductor leadthrough openings also becomes clear such that annularly encircling walls formed from the side walls 10, the contact wall 11 and the end wall 13 project downward from the busbar 7 and provide a guide channel for an electrical conductor.

Figure 5:
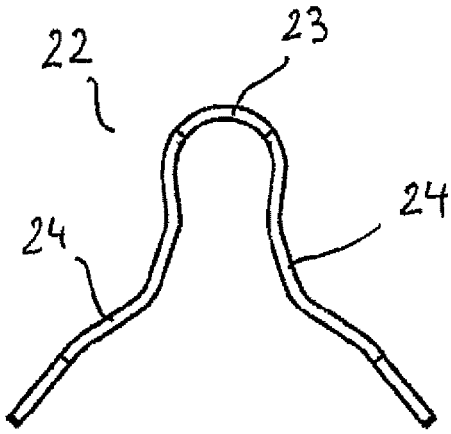
FIG. 5 shows a side view of the four-limbed clamping spring from FIG. 2.

FIG. 5 shows a side view of the clamping spring 22 which is intended to be inserted in the conductor leadthrough openings 8*a*, 8*b*, 8*c*, 8*d* arranged behind one another and beside one another. It becomes clear that two clamping limbs 24 point obliquely downward in opposite directions from a common spring bow 23.

Figure 6:
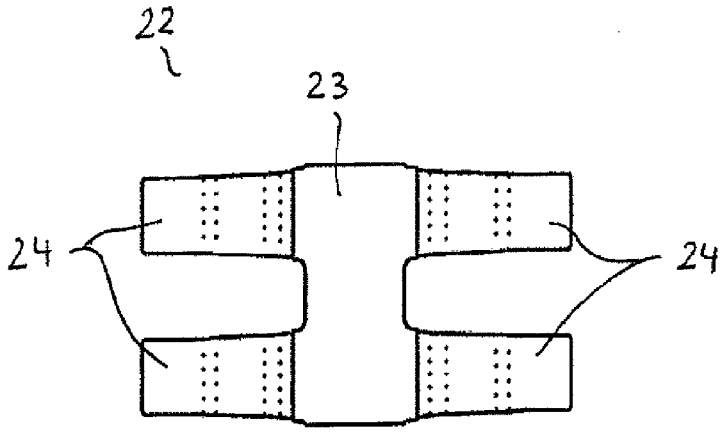
FIG. 6 shows a plan view of the clamping spring from FIG. 5.

FIG. 6 indicates a plan view of the clamping spring 22 from FIG. 5. It becomes clear that not only two clamping limbs 24 point away from one another on a common spring bow 23 but rather that a plurality of such pairs of clamping limbs 24 are integrally connected to the same spring bow 23 while leaving a clearance. The clamping spring 22 can thus be used to connect four electrical conductors with the aid of four conductor leadthrough openings 8*a* to 8*d* arranged behind one another and beside one another. Further alternatives with three, four, five or more pairs of clamping limbs 24 which are arranged opposite one another on a common spring bow 23 are conceivable.

The clamping spring 22 illustrated in FIGS. 5 and 6 can be produced from a spring steel band in virtually continuous production, the number of spring pairs with a common spring bow 23 being selectively cut to length.

Figure 7:
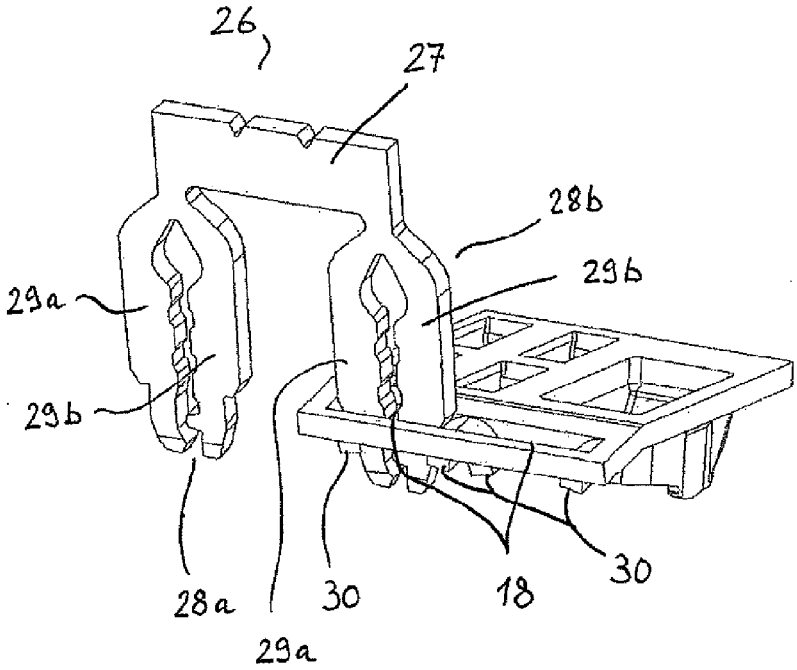
FIG. 7 shows a perspective view of the busbar from FIG. 2 with an inserted transverse link.

FIG. 7 indicates a perspective view of the busbar 7 from FIGS. 3 and 4 with a transverse link 26 inserted into a link contact opening 18. The transverse link 26 has two contact arms 28*a*, 28*b* which leave a transverse web 27 in the same direction and are spaced apart from one another. The contact arms 28*a*, 28*b* are arranged on the same plane as the transverse web 27. It can be seen that the contact arms 28*a*, 28*b* are each formed from two spring arms 29*a*, 29*b* which are spaced apart from one another so as to leave a clearance and are integrally connected to the transverse web 27 in the upper region. The spring arms 29*a*, 29*b* are freely movable as a result of their free ends and can be pressed together during insertion into the link contact opening 18 in order to fixedly rest against the inner narrow side walls of the link contact opening 18 with the lateral edges. In order to move the contact point downward as far as possible, in order to increase the contact surface and in order to insert the transverse link in an improved manner, material flaps 30 are bent downward on the narrow edges of the link contact openings.

Figure 8:
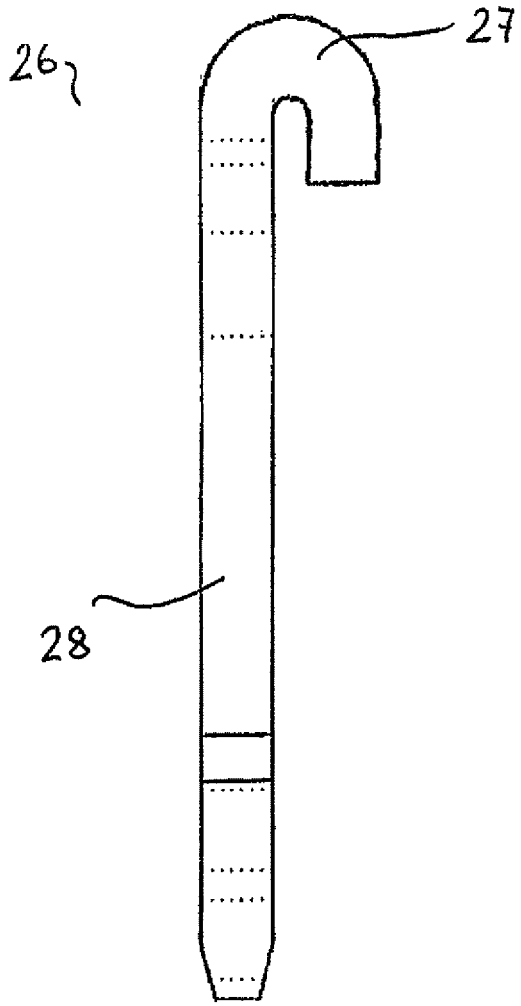
FIG. 8 shows a side view of an embodiment of a transverse link with a transverse web which is folded around.

FIG. 8 indicates a side view of the transverse link 26 from FIG. 7 in a preferred embodiment. It is clear that the transverse web 27 has been bent through 180 degrees and its free end extends downward again in the direction of the free ends of the contact arms 28. This further reduces the height required for the transverse link 26.

Different variants of electrical terminal components 1 can be derived in a simple manner with the aid of a plurality of housing halves.

Figure 9:
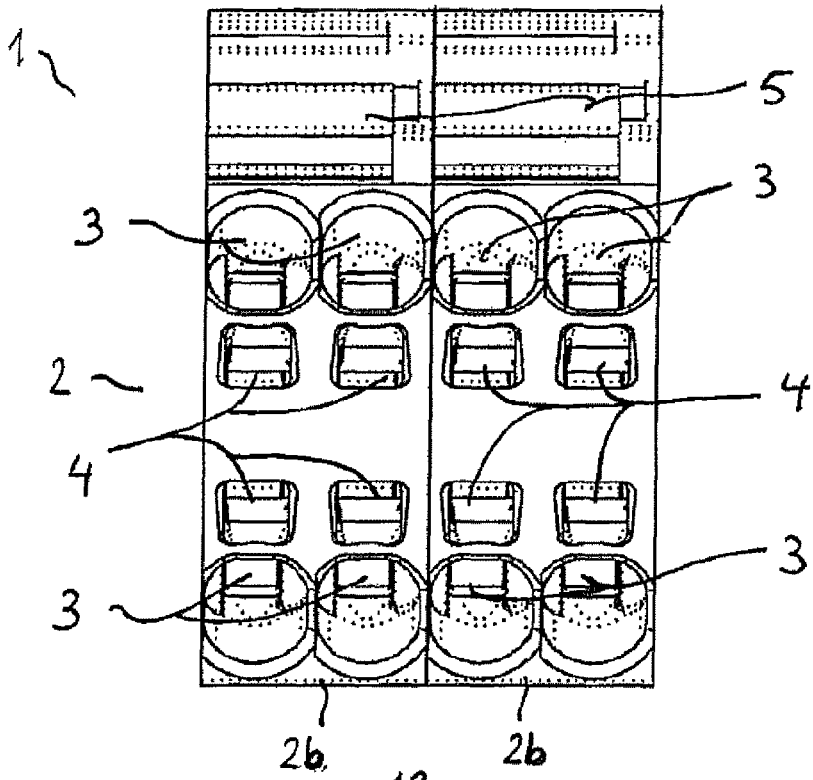
FIG. 9 shows a plan view of a second embodiment of an electrical terminal component.

FIG. 9 shows a plan view of a second embodiment of an electrical terminal component in which eight conductor insertion openings are provided. For this purpose, two identical housing halves 2*b* are joined together.

Figure 10:
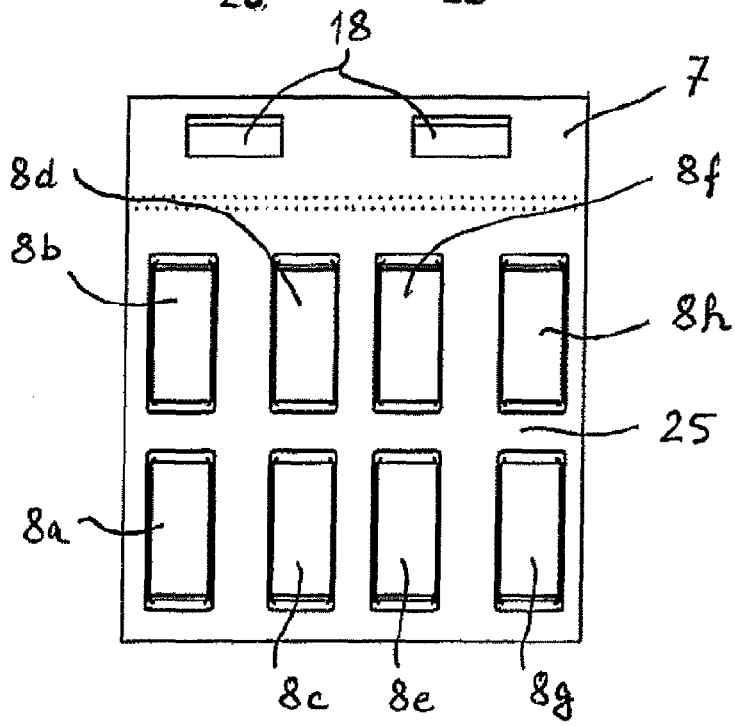
FIG. 10 shows a plan view of the busbar for the electrical terminal component from FIG. 9.

The busbar 7 sketched in the plan view in FIG. 10 is installed in these housing halves 2*b*. It can be seen that the busbar has four pairs of conductor leadthrough openings 8*a* to 8*h* arranged behind one another. Two of the four-limbed springs sketched in FIG. 6 can be inserted into these conductor leadthrough openings. However, it is also conceivable to use an eight-limbed spring, the distances between the pairs of conductor leadthrough openings 8*a* to 8*h* then having to remain the same.

Figure 11:
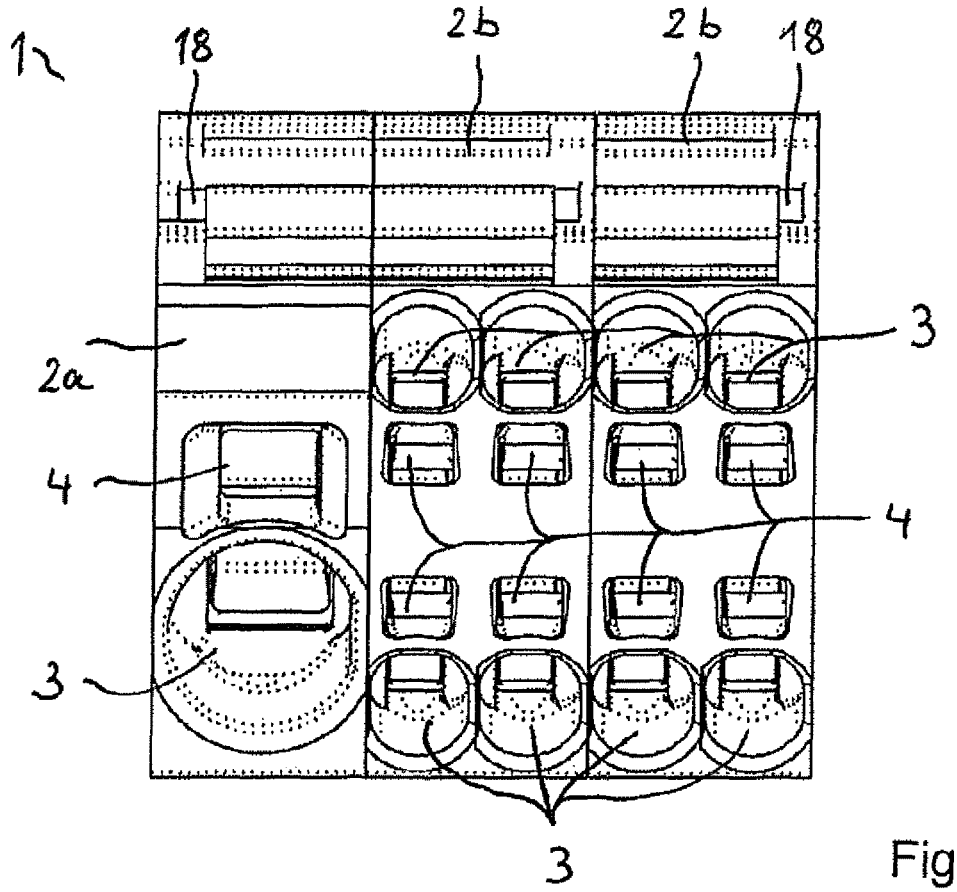
FIG. 11 shows a plan view of a third embodiment of an electrical terminal component.
Figure 12:
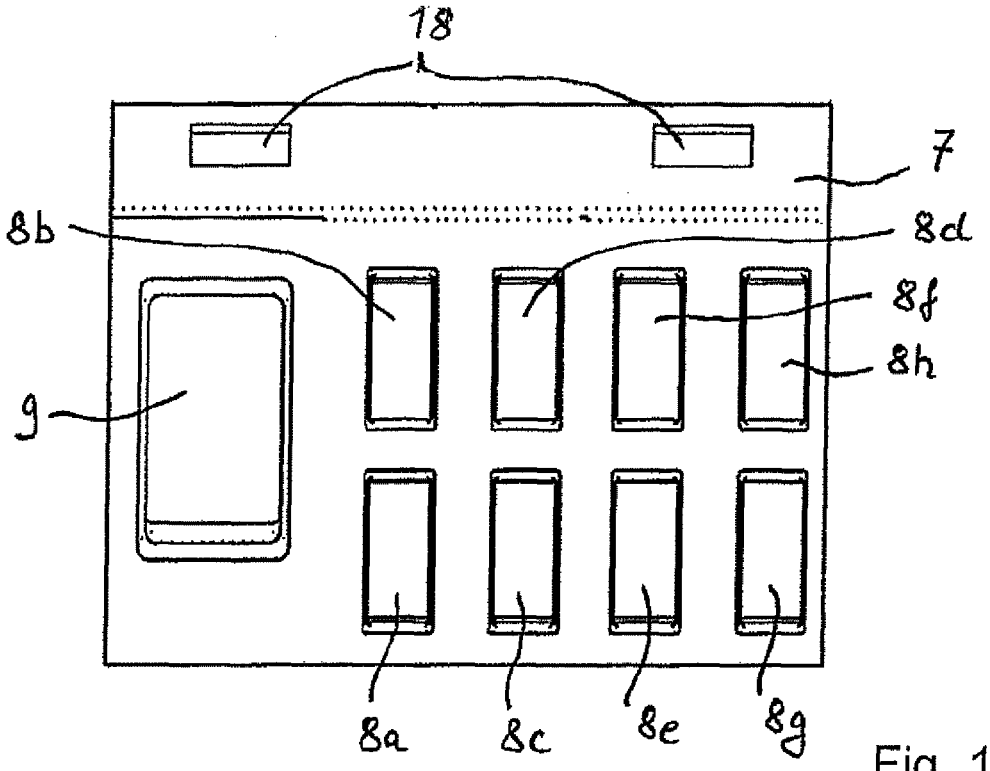
FIG. 12 shows a plan view of a busbar for the electrical terminal component from FIG. 11.

FIG. 11 indicates a plan view of a third embodiment of an electrical terminal component 1. In this embodiment, a conductor connection with a large cross section is provided on the left-hand side and two housing halves 2*b* in the embodiment from FIG. 9 are provided in a manner adjoining said connection. The conductor leadthrough openings 8*a* to 8*h* and the large conductor leadthrough opening 9 are made in a common busbar 7, as can be seen from FIG. 12 in the plan view of the busbar 7.

In a corresponding manner, further conductor connections could also be provided for the purpose of extending the busbar 7, which increases the width of the electrical terminal component 1.

Figure 13:
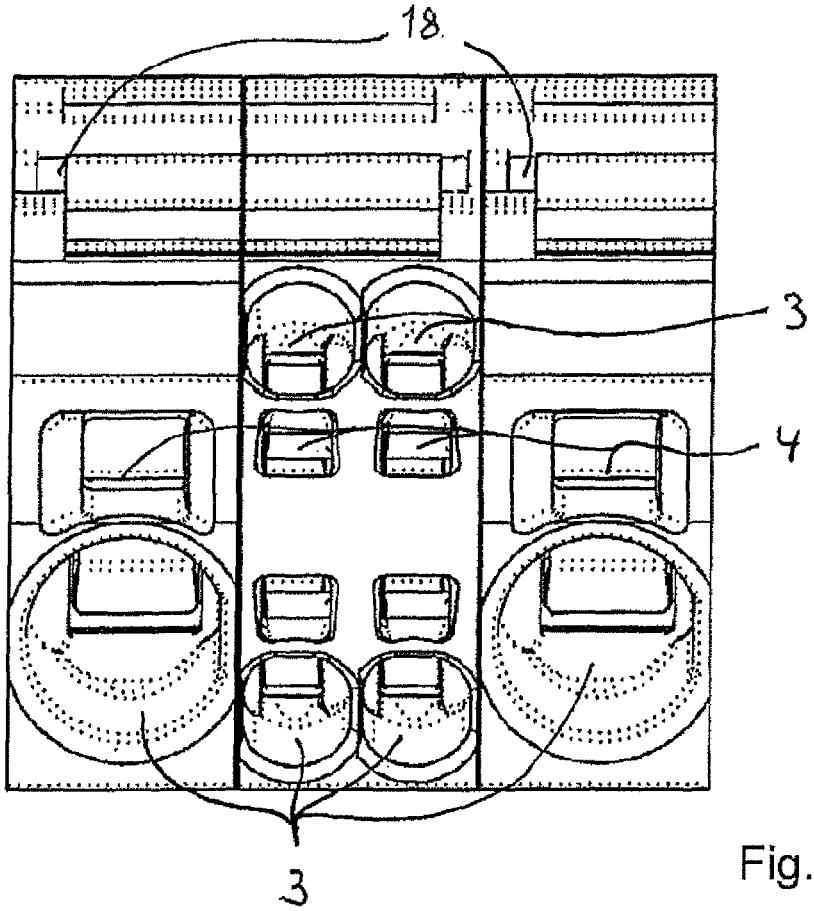
FIG. 13 shows a plan view of a fourth embodiment of an electrical terminal component.

A fourth embodiment of the electrical terminal component 1 is sketched in FIG. 13 which shows a plan view of the terminal component 1. It becomes clear that a respective conductor connection with a larger cross section, for which the larger half 2*a* is used, is provided on the right-hand and left-hand outer sides. A four-way conductor connection is implemented in between using the housing half 2*b*.

Figure 14:
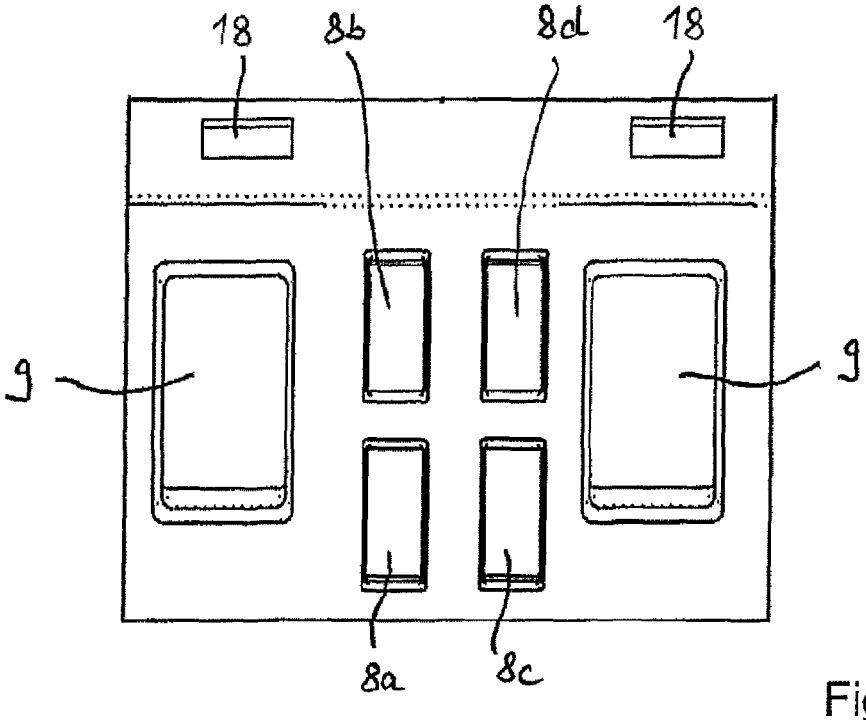
FIG. 14 shows a plan view of a busbar for the electrical terminal component from FIG. 13.

The busbar 7 which is used for this purpose and has the conductor leadthrough openings can be seen in the plan view in FIG. 14.

It also becomes clear in this case that the division of the busbar regions for the housing halves is such that the width of the individual conductor leadthrough opening 9 together with the lateral webs which bound the conductor leadthrough opening corresponds to the width of two adjacently arranged pairs of conductor leadthrough openings 8*a*, 8*b* and 8*c*, 8*d* together with the lateral webs which bound said openings.

The invention claimed is:

1. An electrical terminal component, comprising:

an insulating material housing;

a busbar installed in the insulating material housing; and at least one clamping spring arranged on the busbar so as to form clamping points for electrical conductors, wherein the busbar has a flat busbar region in which there are at least four conductor leadthrough openings which are each surrounded by side walls projecting from the flat busbar region, and a contact wall projecting from the flat busbar region, and having at least one clamping contact point of said clamping points for making contact with an electrical conductor, at least two pairs of two conductor leadthrough openings of said at least four conductor leadthrough openings are each arranged with individual conductors of said two conductor lead through openings behind one another in a direction of longitudinal extent (T) of each two conductor leadthrough openings, and where said at least two pairs of two conductor leadthrough openings are arranged beside one another in a width direction (B) which extends over a narrow side of the at least two pairs of two conductor leadthrough openings.

2. The electrical terminal component according to claim 1, further comprising a web in a plane of the busbar which separates at least one pair of the two conductor leadthrough openings.

3. The electrical terminal component according to claim 1, wherein at least one pair of the two conductor leadthrough openings merge into one another and form a common opening closed on all sides in a plane of the busbar, and where said at least one clamping contact point includes at least two clamping contact points for two electrical conductors which are foamed by mutually opposite contact walls.

4. The electrical terminal component according to claim 1, further comprising link contact openings for receiving and making contact with transverse links provided on a plane of the busbar which has the conductor leadthrough openings.

5. The electrical terminal component according to claim 4, wherein the link contact openings are arranged on a plane which is angled from the plane of the busbar-which has the conductor leadthrough openings by a maximum of 20 degrees.

6. The electrical terminal component according to claim 4, further comprising material flaps which project from the plane of the busbar which has the conductor leadthrough openings at the lateral edges of the link contact openings.

7. The electrical terminal component according to claim 1, wherein the at least one clamping spring includes a plurality of clamping springs each having a spring bow and at least two adjacent and spaced apart pairs of mutually opposite clamping limbs which adjoin the spring bow and each are configured to interact with one of two opposite contact walls of a pair of said two pairs of conductor leadthrough openings, so that electrical conductors which each adjoin the two opposite contact walls of the pair of conductor leadthrough openings are connected to the mutually opposite clamping limbs of one of said pairs of mutually opposite clamping limbs.

8. The electrical terminal component according to claim 1 further comprising:

an individual conductor leadthrough opening positioned adjacent said at least two pairs of two conductor leadthrough openings, said individual conductor leadthrough opening having side walls which extend away from a plane of the busbar and bound the individual conductor leadthrough opening, and having a contact wall, and a clamping spring inserted into the individual conductor leadthrough opening.

9. The electrical terminal component according to claim 8, wherein a width of the individual conductor leadthrough opening together with lateral webs which bound the individual conductor leadthrough opening correspond approximately to a width of two adjacently arranged pairs of conductor leadthrough openings together with lateral webs which bound said two adjacently arranged pairs of conductor leadthrough openings.

10. The electrical terminal component according to claim 1, further comprising two mutually opposite recessed grips on the outside of the insulating material housing.

11. A transverse link for an electrical terminal component comprising an insulating material housing; a busbar installed in the insulating material housing; and at least one clamping spring arranged on the busbar so as to form clamping points for electrical conductors, wherein the busbar has a flat busbar region in which there are at least four conductor leadthrough openings which are each surrounded by side walls projecting from the flat busbar region, and a contact wall projecting from the flat busbar region, and having at least one clamping contact point of said clamping points for making contact with an electrical conductor, at least two pairs of two conductor leadthrough openings of said at least four conductor leadthrough openings are each arranged with individual conductors of said two conductor lead through openings behind one another in a direction of longitudinal extent (T) of each two conductor leadthrough openings, and where said at least two pairs of two conductor leadthrough openings are arranged beside one another in a width direction (B) which extends over a narrow side of the at least two pairs of two conductor leadthrough openings, comprising:

an electrically conductive transverse web; and at least two contact arms which project from the transverse web and are spaced apart from one another, wherein the transverse web is bent away from an axis of extent of the contact arms and is at an acute angle to the contact arms.

* * * * *